US005993233A

United States Patent [19]

Fukuda

[11] Patent Number: 5,993,233

[45] Date of Patent: Nov. 30, 1999

[54] WATERPROOF CONNECTOR HOUSING AND METHOD OF MANUFACTURING THE SAME

[75] Inventor: Masaru Fukuda, Shizuoka, Japan

[73] Assignees: Yazaki Corporation, Tokyo; Toyota Jiddosha Kabushiki Kaisha, Toyota, both of Japan

[21] Appl. No.: 08/923,600

[22] Filed: Sep. 4, 1997

[30] Foreign Application Priority Data

Sep. 4, 1996 [JP] Japan ..... 8-234074

[51] Int. Cl.[6] ..... H01R 13/432

[52] U.S. Cl. ..... 439/271; 439/589

[58] Field of Search ..... 439/271, 274, 439/589, 936

[56] References Cited

U.S. PATENT DOCUMENTS

| | | | |
|---|---|---|---|
| 4,588,242 | 5/1986 | McDowell et al. | 439/271 |
| 4,842,540 | 6/1989 | Endo et al. | 439/271 |
| 5,334,039 | 8/1994 | Kanda | 439/271 |
| 5,518,415 | 5/1996 | Sano | 439/589 |
| 5,823,811 | 10/1998 | Blanchfield et al. | 439/589 |
| 5,922,263 | 7/1999 | Endo et al. | 439/271 |

FOREIGN PATENT DOCUMENTS

| | | | |
|---|---|---|---|
| 3-219578 | 9/1991 | Japan . | |
| 5-47436 | 2/1993 | Japan . | |
| 8904072 | 5/1989 | WIPO | 439/271 |

*Primary Examiner*—Paula Bradley
*Assistant Examiner*—Tho D. Ta
*Attorney, Agent, or Firm*—Armstrong, Westerman, Hattori, McLeland & Naughton

[57] ABSTRACT

The waterproof connector housing according to the present invention comprises a connector housing which includes a housing body having a plurality of terminal receiving chambers and an engagement frame formed around a peripheral wall of said housing body for receiving a mating connector, and a waterproof packing integrally formed with said connector housing between said housing body and said engagement frame, wherein an insertion groove is formed in at least one portion of the peripheral wall of the housing body for injecting a packing material therethrough, said insertion groove extending from a mating face between the housing body and the mating connector in a receiving direction of the mating connector. With such a construction an easy and reliable insertion of the packing material is attained, thus enhancing waterproofness of the connector housing. Further, the injected packing material remains inside an inlet of said insertion groove without overflowing therefrom. Because the waterproof packing is not exposed to the exterior, an attack by high pressure water at high pressure cleaning can be avoided.

4 Claims, 5 Drawing Sheets

WATERPROOF CONNECTOR HOUSING AND METHOD OF MANUFACTURING THE SAME

FIELD OF THE INVENTION

This invention relates to a waterproof connector housing applicable to a waterproof connector comprising a ring-like waterproof packing between a male connector and a female connector.

DESCRIPTION OF THE PRIOR ART

There has been proposed in Japanese Patent Laid-open Publication No-3-219578 a waterproof connector housing as shown in the attached drawing, FIG. 7 wherein a ring-like packing is integrally formed with the connector housing.

In FIG. 7, the waterproof connector housing 51 includes a connector housing 54 having a plurality of terminal receiving chambers 52 and a hood 53 for receiving a mating connector (not shown). Between an outer face 54*a* of the housing 54 and the hood 53 is formed a ring-like waterproof packing 55.

The waterproof connector housing 51 in which the waterproof packing 55 is integrally formed with the housing 54 is manufactured through the steps of a primary molding and a secondary molding. In the primary molding, the connector housing is molded by filling material (not shown) between a pair of metal molds (not shown). Then in the secondary molding, one of the molds is replaced with another mold 56 for forming the waterproof packing (FIG. 8). The mold 56 and the other mold 57 are closed and a fluid rubber 59 is injected into an opening 53*a* through an insertion hole 58 in the mold 56 to fill a cavity 60 thereby obtaining an integral forming of the waterproof packing 55 with the connector housing 54.

However, as shown in FIG. 7, the obtained waterproof packing 55 is exposed to the exterior from the opening 53*a*. This is a drawback because the exposed waterproof packing 55*a* will be damaged when attacked by high pressure water or the like at high pressure cleaning. To eliminate this drawback, there is proposed a waterproof connector housing 61 in which a waterproof packing 65 is not exposed to the exterior as shown in FIG. 9.

Manufacturing of a waterproof connector housing 61 in which the waterproof packing 65 is integrally formed with the connector housing 54 is illustrated in FIG. 10. After the primary molding, one metal mold 66 and the other metal mold 67 are closed, and then, the fluid rubber 59 is injected into an insertion hole 68 formed in said other mold 67 to fill the cavity 60. When the fluid rubber 59 is set, the pair of molds 66, 67 are opened to take out the molded waterproof connector housing 61.

However, the insertion hole 68 formed in the other metal mold 67 for the secondary molding extends into the cavity 60 between the hood 53 and the connector housing 54. Thus, the insertion hole 68 is forced to be narrow and long, which makes it difficult in practice to form said insertion hole 68 in the other metal mold 67.

SUMMARY OF THE INVENTION

In view of the above drawbacks, it is an object of this invention to provide a waterproof connector housing in which the fluid rubber can be easily injected at the secondary molding and the formed waterproof packing is not exposed to the exterior.

In order to attain the above object, the waterproof connector housing according to this invention comprises a connector housing which includes a housing body having a plurality of terminal receiving chambers and an engagement frame formed around a peripheral wall of said housing body for receiving a mating connector, and a waterproof packing integrally formed with said connector housing between said housing body and said engagement frame, wherein an insertion groove is formed in at least one portion of the peripheral wall of the housing body for injecting a packing material therethrough, said insertion groove extending from a mating face between the housing body and the mating connector in a receiving direction of the mating connector.

A waterproof connector housing wherein the injected packing material remains inside an inlet of said insertion groove without overflowing therefrom is also effective.

BRIEF DESCRIPTION OF THE DRAWINGS

These and other objects, features and advantages of this invention will be apparent from the following detailed description of the preferred embodiments and best mode, appended claims, and accompanying drawings in which:

DETAILED DESCRIPTION OF A PREFERRED EMBODIMENT

FIGS. 1 to 6 illustrate a preferred embodiment of the waterproof connector housing according to this invention.

Figure 1:
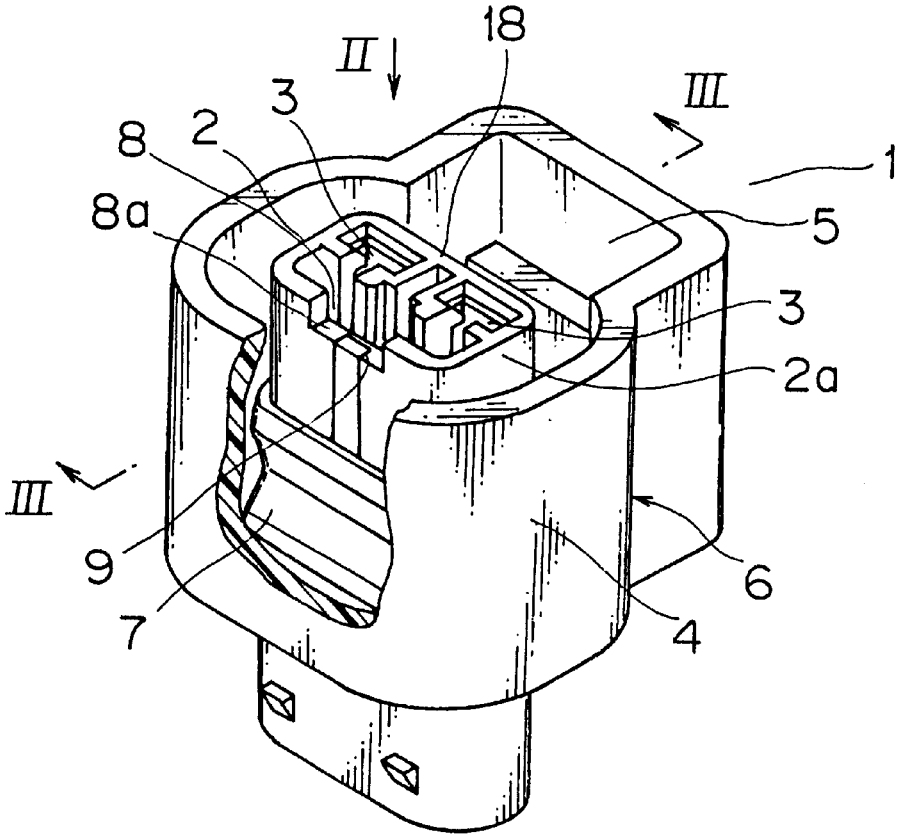
FIG. 1 is a perspective view of a waterproof connector housing according to one embodiment of this invention.
Figure 2:
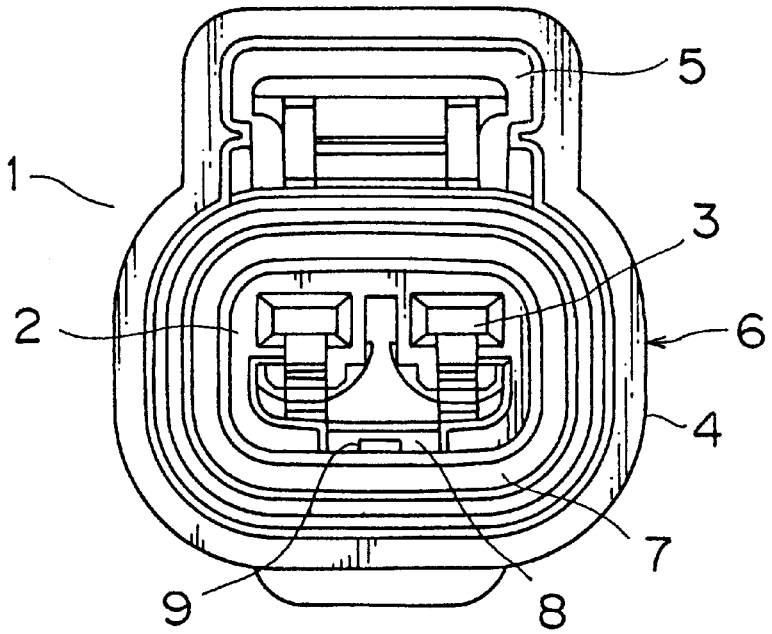
FIG. 2 is a view seen in a direction II of FIG. 1.

In FIG. 1, a waterproof connector housing 1 comprises a connector housing 6 which includes a housing body 2 having a plurality of terminal receiving chambers 3, an engagement frame 4 formed around a peripheral wall 2*a* of said body 2 for receiving a mating connector, and a locking chamber 5 formed in said frame 4 for receiving a locking element of the mating connector, and a ring-like packing 7 (FIG. 2) integrally formed with said connector housing 6 between the housing body 2 and the engagement frame 4.

Figure 6:
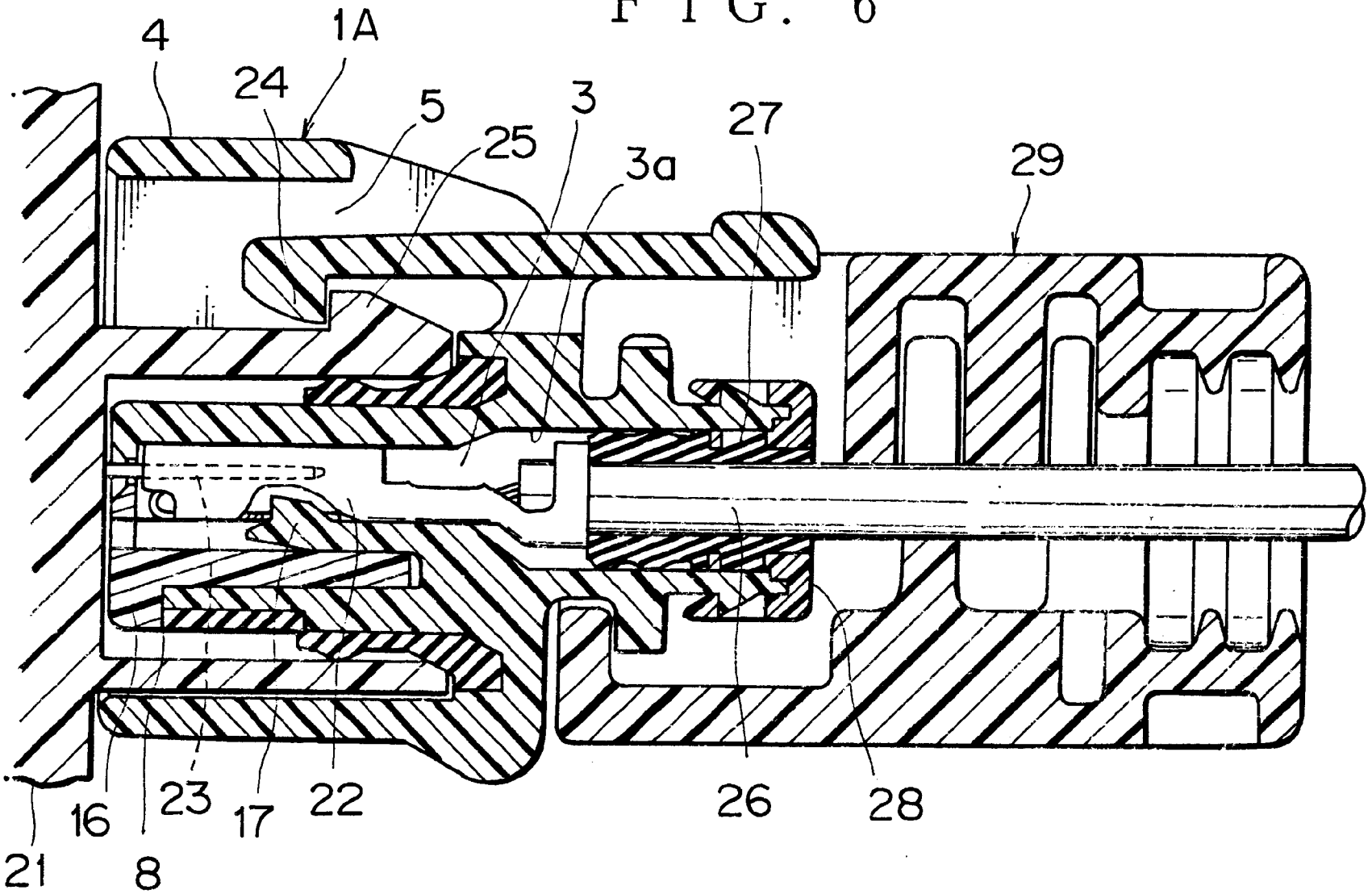
FIG. 6 is a cross-sectional view of the waterproof connector housing having a terminal locked therein in a mated state with a mating connector.
Figure 8:
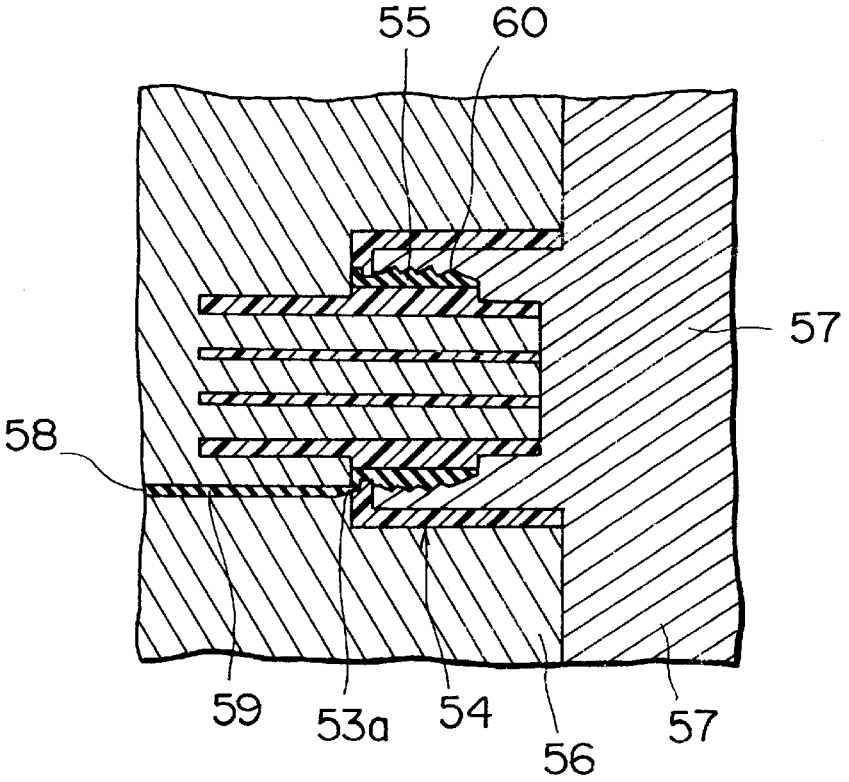
FIG. 8 PRIOR ART
FIG. 8 is a drawing for explaining a method of molding the conventional waterproof connector housing.
Figure 10:
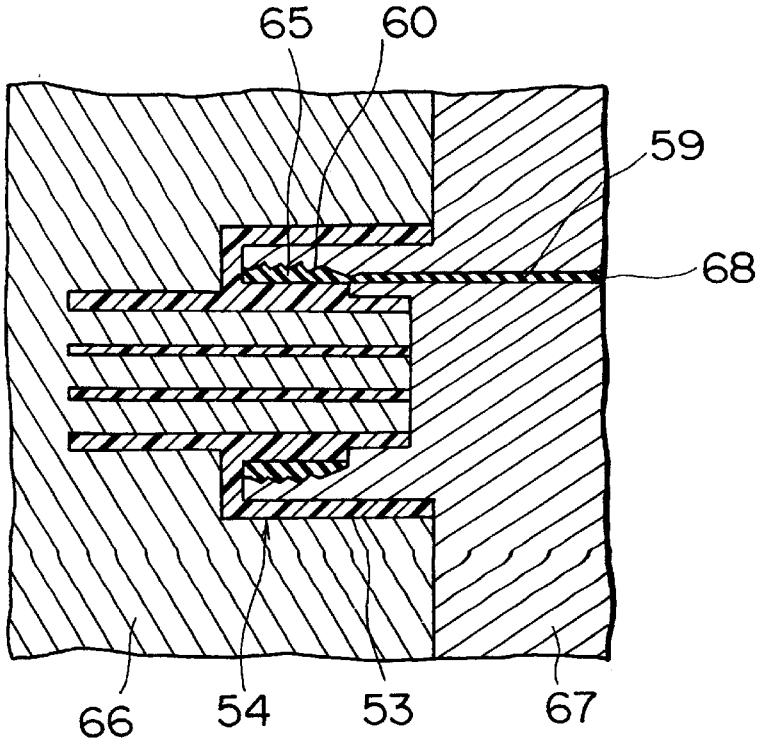
FIG. 10 PRIOR ART
FIG. 10 is a drawing for explaining a method of molding said another conventional waterproof connector housing.

A cut-out 8 for mounting a press bar 16 (FIG. 6) is formed on the top portion of the peripheral wall 2*a* of the housing body 2 at the side opposite to the locking chamber 5. As shown in FIG. 6, the press bar 16 is provided in the terminal receiving chamber 3 for locking a resilient locking member 17 which is formed in the terminal receiving chamber 3 for locking a terminal 22 inserted therein thereby preventing the terminal 22 from slipping off.

Figure 3:
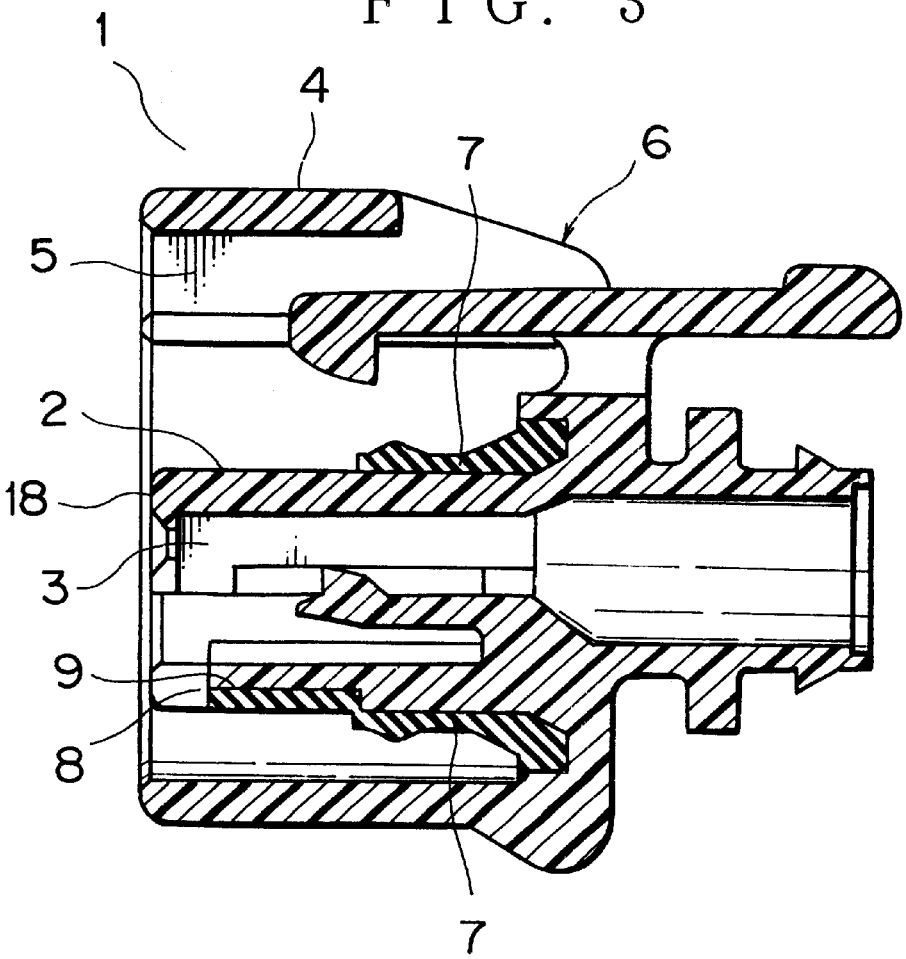
FIG. 3 is a cross-sectional view taken along a line III—III in FIG. 1.
Figure 5:
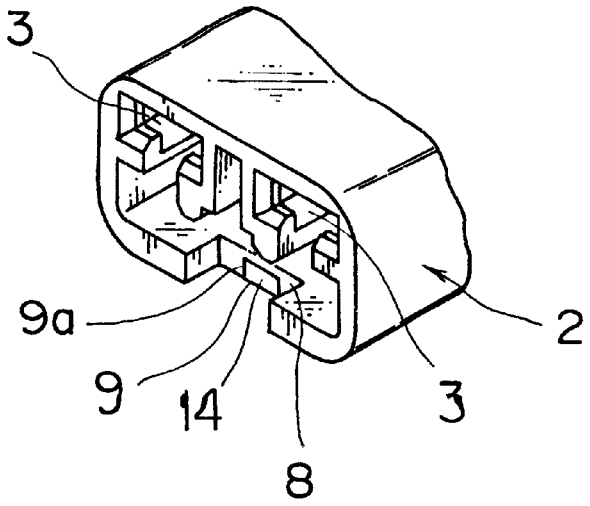
FIG. 5 is a drawing for showing an insertion groove with a fluid rubber injected therein.

In the peripheral wall 2*a* is formed a concaved insertion groove 9 extending from a bottom wall 8*a* of the cut-out 8 in a mating direction of the mating connector (FIG. 3). The groove can be formed at any desired part of the peripheral wall 2*a*. A fluid rubber 14 is injected into the groove 9 through an inlet 9*a* at the side of a mating face. Then the fluid rubber 14 flows into the base portion of the frame 4 where it is set along the peripheral wall 2*a* to form the waterproof packing 7.

Figure 4:
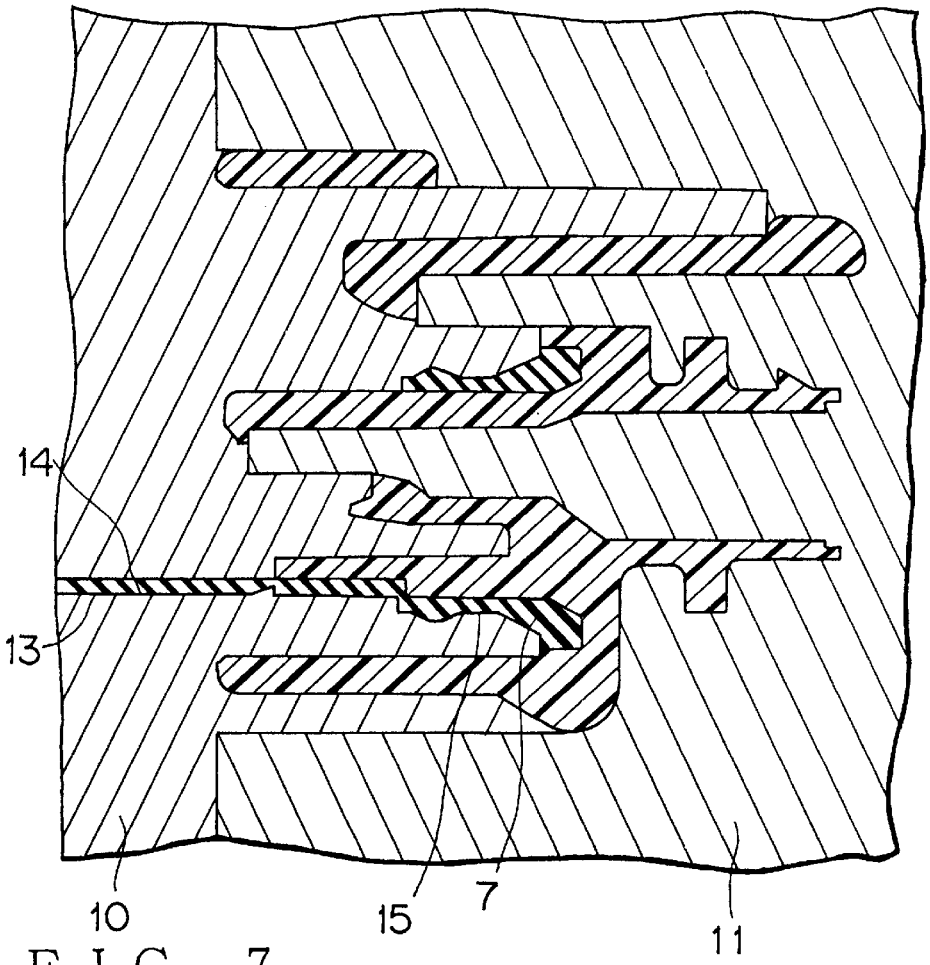
FIG. 4 is a drawing for explaining a method of molding the waterproof connector housing.
Figure 7:
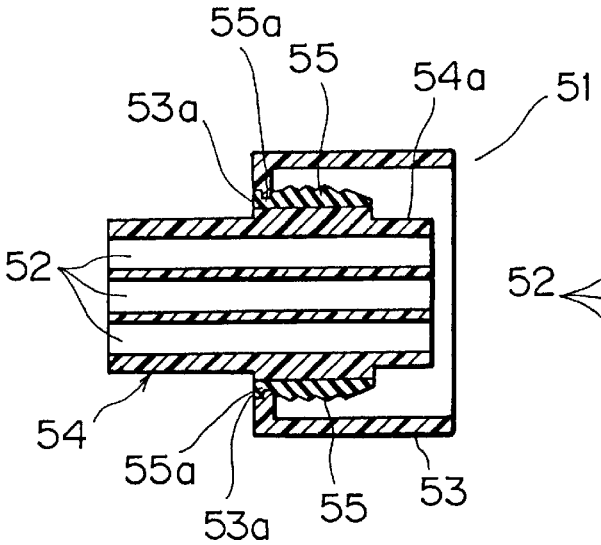
FIG. 7 PRIOR ART
FIG. 7 is a cross-sectional view of a conventional waterproof connector housing.
Figure 9:
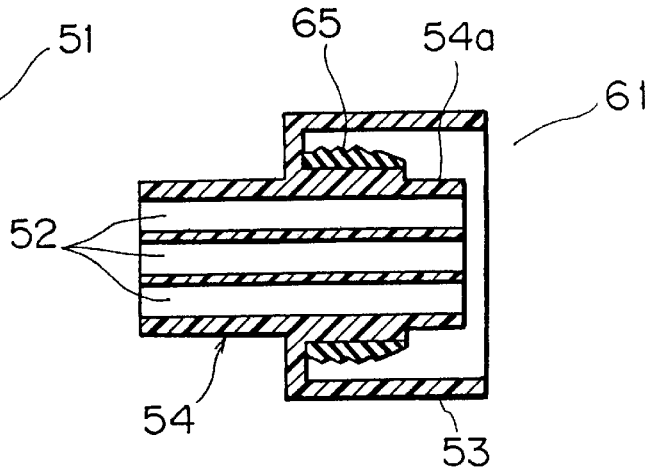
FIG. 9 PRIOR ART
FIG. 9 is a cross-sectional view of another conventional waterproof connector housing.

Now, a method of manufacturing the waterproof connector housing 1 by integrally forming the waterproof packing 7 through the secondary molding with the connector housing 6 obtained by the primary molding is explained hereunder. As shown in FIG. 4, a pair of metal molds 10, 11 are clamped together and then, a fluid rubber 14 is injected into an insertion hole 13 formed in one of the molds 10 in open connection with the groove 9. Said fluid rubber 14 flows from the insertion hole 13 through the groove 9 to fill a packing cavity 15 formed in the other mold 11. When the rubber is set, the pair of molds 10, 11 are removed to obtain the waterproof connector housing 1.

As described above, since the groove 9 is formed in the housing body 2, the insertion hole 13 in the one mold 10 is not so small in cross-section. The insertion hole 13 is made larger in cross-section than in the conventional waterproof connector housing. Accordingly, an easy and reliable insertion of the fluid rubber 14 into the packing cavity 15 can be attained, thus enhancing waterproofness of the connector housing 1.

The fluid rubber 14 is injected in such a manner that it remains inside the insertion groove 9 near the inlet 9*a* so as not to leak or overflow from the inlet 9*a* after the cavity 15 is filled with the fluid rubber 14. Once the fluid rubber 14 is set to form the waterproof packing 7, the waterproof packing 7 is positioned between the housing body 2 and the engagement frame 4 and not exposed from the mating face 18 of the housing body 2 as well as from the peripheral wall 2*a* at the side of the mating face 18. Therefore, the high pressure water does not directly attack the waterproof packing 7 at high pressure cleaning, thus preventing a damage to the waterproof packing 7 thereby improving reliability of its waterproofness.

Now referring to FIG. 6, the waterproof connector housing 1 in a mated state with a mating connector 21 is explained.

The terminal 22 is housed and locked in the terminal receiving chamber 3 of the waterproof connector housing 1 to form a waterproof connector 1A. When the mating connector 21 having a terminal 23 comes into engagement with the connector 1A, the terminals 22 and 23 are electrically connected and simultaneously, a locking element 24 formed in the locking chamber 5 of the waterproof connector 1A engages with a locking element 25 of the mating connector 21.

Between an electric wire 26 pressure bonded to the terminal 22 and an inner wall 3*a* of the terminal receiving chamber 3 is inserted a waterproof plug 27. A plug cover 28 is mounted on the waterproof connector 1A to hold the waterproof plug 27. The electric wire 26 extending from the plug cover 28 is secured and protected by a wire holding member 29. The mating connector 21 may be replaced by a connector of the type directly attached to an electric apparatus.

As described above, the packing material is injected along the insertion groove formed in the peripheral wall of the housing body and extending from the mating face in a direction of receiving the mating connector to fill the packing cavity between the housing body and the engagement frame. Therefore, as compared with the conventional connector housing, the insertion hole formed in one of the pair of molds used for the secondary integral molding of the connector housing and the waterproof packing is made larger in cross-section. Thus the packing material can be easily injected into the insertion groove of the connector housing.

Further, the injected packing material remains inside the inlet of the insertion groove and is not exposed from the peripheral wall of the housing body. This eliminates a danger that the waterproof packing is attacked by high pressure water at high pressure cleaning, thus preventing damages of the waterproof packing.

What is claimed is:

1. A waterproof connector housing comprising:

a connector housing which includes a housing body having a plurality of terminal receiving chambers and an engagement frame formed around a peripheral wall of said housing body for receiving a mating connector; and a waterproof packing integrally formed with said connector housing in a packing cavity between said housing body and said engagement frame;

wherein an insertion groove is formed in at least one portion of the peripheral wall of the housing body for injecting a packing material therethrough, said insertion groove extending from a mating face between the housing body and the mating connector in a receiving direction of the mating connector.

2. A waterproof connector housing as claimed in claim 1, wherein said insertion groove extends from a bottom wall of a cut-out formed on a top portion of the peripheral wall.

3. A waterproof connector housing as claimed in claim 1 or 2, wherein the injected packing material remains inside an inlet of said insertion groove without overflowing therefrom.

4. A waterproof connector housing as claimed in claim 1 or 2, wherein said injected packing material is fluid rubber.

* * * * *